United States Patent [19]

Meddaugh et al.

[11] 4,382,208

[45] May 3, 1983

[54] VARIABLE FIELD COUPLED CAVITY RESONATOR CIRCUIT

[75] Inventors: Gard Meddaugh, Mountain View; Eiji Tanabe, Sunnyvale; Victor Vaguine, Palo Alto, all of Calif.

[73] Assignee: Varian Associates, Inc., Palo Alto, Calif.

[21] Appl. No.: 172,918

[22] Filed: Jul. 28, 1980

[51] Int. Cl.[3] ..... H01J 25/10

[52] U.S. Cl. ..... 315/5.41; 315/5.42; 315/5.46; 328/233

[58] Field of Search ..... 315/5.41, 5.42, 5.46; 328/233

[56] References Cited

U.S. PATENT DOCUMENTS

| | | | |
|---|---|---|---|
| 3,153,767 | 10/1964 | Kyhl | 315/5.42 X |
| 3,906,300 | 9/1975 | Tran | 315/5.41 |
| 4,118,652 | 10/1978 | Vaguine | 315/5.41 |
| 4,286,192 | 8/1981 | Tanabe et al. | 315/5.41 |

*Primary Examiner*—Saxfield Chatmon, Jr.

*Attorney, Agent, or Firm*—Stanley Z. Cole; Leon F. Herbert

[57] ABSTRACT

In a resonant chain of coupled cavities such as used in a standing-wave linear particle accelerator it is often desirable to change the field strength in some cavities relative to some others. For example, if the output particle energy of an accelerator is changed by varying the fields of all cavities, the distribution of energies of output particles is disturbed. This distribution is largely controlled by the fields in the first group of cavities traversed by the particle beam. According to the invention, the fields can remain constant in the first group and be varied in following cavities. This is done by varying the distribution of electromagnetic field in one cavity asymmetrically with respect to the preceding and the following cavity. The asymmetric coupling produces different acceleration fields in one part of acceleration structure relative to another part.

In an accelerator whose accelerating cavities are coupled via non-interacting side cavities, the different coupling may be produced by making the standing-wave field in one side-cavity asymmetric with respect to its coupling irises.

22 Claims, 4 Drawing Figures

FIG.1
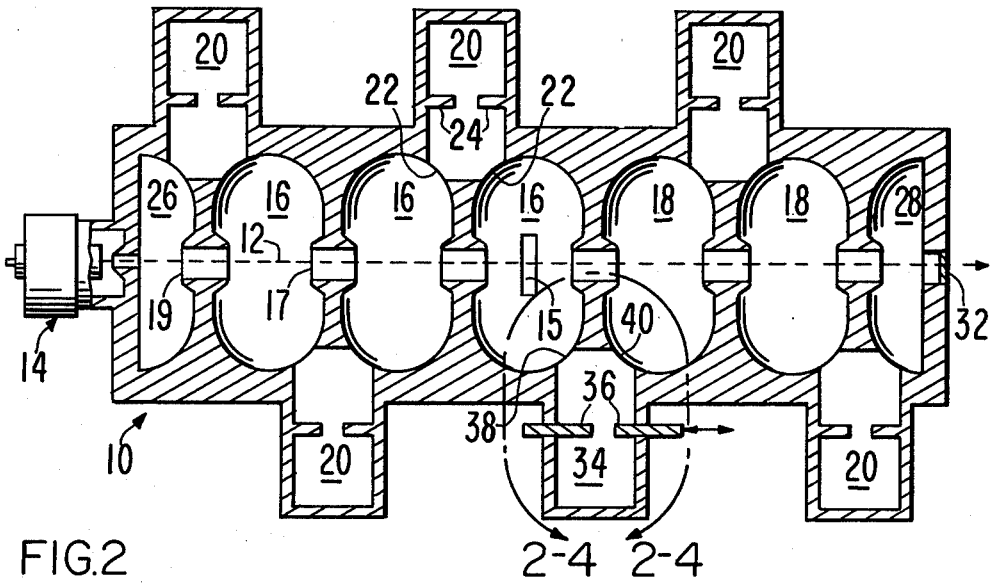
FIG.2
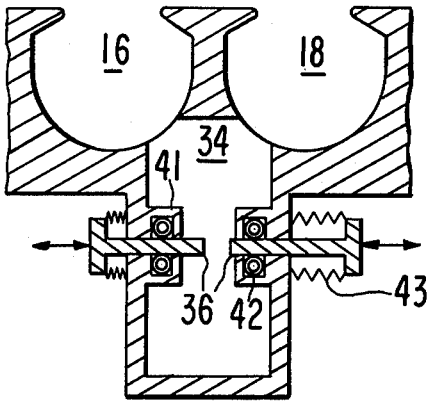
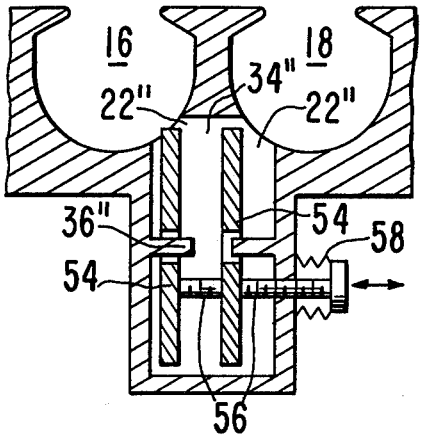
FIG. 4
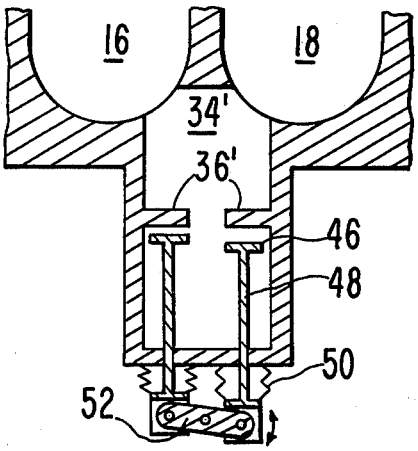
FIG.3

VARIABLE FIELD COUPLED CAVITY RESONATOR CIRCUIT

DESCRIPTION

FIELD OF THE INVENTION

The invention pertains to standing-wave coupled-cavity circuits such as used in standing-wave linear particle accelerators.

PRIOR ART

It is very desirable to obtain beams of energetic charged particles with a narrow spread of energy, such average energy being variable over a wide dynamic range. Moreover it is desirable that the spread of energy, $\Delta$ E be independent of the value of the average final accelerated energy E.

One straightforward approach to accomplishing variable energy control in a linear accelerator is to vary the power supplied from the rf source to the accelerating cavities. The lower accelerating electric field experienced by the beam particles in traversing the accelerating cavities results in lower final energy. A variable attenuator in the wave guide which transmits rf power between the source and accelerator can provide such selectable variation in the amplitude of the accelerating electric field. This approach suffers from a degradation in the beam quality of the accelerated beam due to an increased energy spread $\Delta$ E in the final beam energy. The dimensions of the accelerator can be optimized for a particular set of operating parameters, such as design output energy, beam current and input rf power. However, that optimization will not be preserved when the rf power is changed because the velocity of the electrons, and hence the phase of the electron bunch relative to the rf voltages of the cavities, is varied. The carefully designed narrow energy spread is thus degraded.

Another approach of the prior art is to cascade two traveling-wave sections of accelerator cavities. The two sections are independently excited from a common source with selectable attenuation in amplitude and variation in phase applied to the second section. Such accelerators are described by Ginzton, U.S. Pat. No. 2,920,228, and by Mallory, U.S. Pat. No. 3,070,726, commonly assigned with the present invention. These traveling-wave structures are inherently less efficient than side-coupled standing-wave accelerators because energy that is not transferred to the beam must be dissipated in a load after a single passage of the rf wave energy through the accelerating structure. Also, the effective shunt impedance of traveling wave structures is lower than in side-coupled standing-wave accelerators.

Still another accelerator of the prior art described in U.S. Pat. No. 4,118,653 issued Oct. 3, 1978 to Victor Aleksey Vaguine and commonly assigned with the present invention, combined a traveling-wave section of accelerator, producing an optimized energy and energy spread, with a subsequent standing-wave accelerator section. Both the traveling-wave and standing wave sections were excited from a common rf source, with attenuation provided for the excitation of the standing-wave section. In the standing-wave portion of the accelerator there is little effect on the accelerated and bunched beam for which the velocity is very close to the velocity of light and therefore substantially independent of the energy. However, this scheme requires that two greatly different types of accelerator section must be designed and built, and also relatively complex external microwave circuitry is required.

Another standing-wave linear accelerator exhibiting variable beam energy capability is realized with an accelerator comprising a plurality of electromagnetically decoupled substructures. Each substructure is designed as a side-cavity coupled accelerator. The distinct substructures are coaxial but interlaced such that adjacent accelerating cavities are components of different substructures and electromagnetically decoupled. Thus adjacent cavities are capable of supporting standing waves of different phases. The energy gain for a charged particle beam traversing such an accelerator is clearly a function of the phase distribution. For an accelerator characterized by two of such interleaved substructures, maximum beam energy is achieved when adjacent accelerating cavities differ in phase by $\pi/2$, the downstream cavity lagging the adjacent upstream cavity, and the distance between adjacent accelerating cavities is $\frac{1}{4}$ the distance traveled by an electron in one rf cycle. Adjustment of the phase relationship between substructures results in variation of beam energy. Such an accelerator is described in U.S. Pat. No. 4,024,426 issued May 17, 1977 to Victor A. Vaguine and commonly assigned with the present invention. While it provides good efficiency and energy control, the structure is more complex than the present invention.

Here we need to add another approach by Dr. D. T. Tran, U.S. Pat. No. 4,162,423 filed July 1979.

Another scheme to provide variable energy in combination with preserving the energy spectrum is described in U.S. patent application Ser. No. 84,284 by Eiji Tanabe and Victor A. Vaguine filed Oct. 12, 1979, now U.S. Pat. No. 4,286,192 and co-assigned with the present application. In this scheme, the phase of the coupling between two adjacent accelerating cavities is reversed, whereby in all succeeding downstream cavities the particles are decelerated instead of accelerated. This arrangement will vary the energy by a single built-in step. To provide a range of energies one would require a multiplicity of phase-reversal cavities spread along the accelerator section.

SUMMARY OF THE INVENTION

An object of the invention is to provide a linear coupled-cavity resonator circuit in which the fields in one part of the circuit may be varied by a desired amount with respect to those in another part.

A further object is to provide a coupled-cavity linear particle accelerator in which the output particle energy can be varied while the distribution of particle energies remains unchanged.

These objects are achieved in a normally uniform series of coupled cavities by a mechanical deformation of one cavity to make its standing-wave electromagnetic field asymmetric with respect to its coupling means to the two adjacent cavities. In the common standing-wave structure coupled by side cavities, the transformation is formed by producing an asymmetric field distribution in one of the side cavities. A linear accelerator can then be operated with constant fields in the first group of cavities traversed by the beam in which the energy distribution of particles is largely determined. The mean particle energy may then be varied by varying the fields in a following group of cavities, without affecting the energy distribution spectrum.

BRIEF DESCRIPTION OF THE DRAWINGS

FIG. 1 is a schematic axial cross-section of a linear accelerator embodying the invention.

FIG. 2 is a detailed section of a portion of FIG. 1.

FIG. 3 is a schematic section of a portion of a capacity-loaded embodiment.

FIG. 4 is a schematic section of an embodiment in which the rf magnetic field is displaced.

DESCRIPTION OF THE PREFERRED EMBODIMENTS

FIG. 1 is a schematic axial section of a charged particle standing wave accelerator structure embodying the invention. It comprises a chain 10 of electromagnetically coupled resonant cavities. A linear beam of electrons 12 is injected by an electron gun source 14. Beam 12 may be either continuous or pulsed.

The standing wave accelerator structure 10 is excited by microwave power at a frequency near its resonant frequency typically 3 GHz. The power enters one cavity 16, preferably the center cavity of the chain, thru an iris 15.

The cavities of chain 10 are of two types. Accelerating cavities 16, 18 are doughnut-shaped and have central beam apertures 17 which are aligned to permit passage of beam 12. Cavities 16 and 18 have projecting noses 19 of optimized configuration in order to improve efficiency of interraction of microwave power and electron beam. For electron accelerators, cavities 16, 18 are all alike because the electron beam 12 is already traveling at near the speed of light when it enters accelerator chain 10.

Each adjacent pair of accelerating cavities 16, 18 are electromagnetically coupled together thru a "side" or "coupling" cavity 20 which is coupled to each of the pair by an iris 22. Coupling cavities 20 are resonant at the same frequency as accelerating cavities 16, 18 and do not interact with beam 12. In this embodiment, they are of cylindrical shape with a pair of projecting center conductors 24.

The frequency of excitation is such that chain 10 is excited in a standing-wave resonance with $\pi/2$ radians phase shift between each coupling or accelerating cavity and the adjacent downstream cavity. Thus, there is $\pi$ radians shift between adjacent accelerating cavities 16, 18. The $\pi/2$ mode has several advantages. It has the greatest separation of resonant frequency from adjacent modes which might be accidentally excited. Also, when chain 10 is properly terminated, there are very small electromagnetic fields in coupling cavities 20 so the power losses in these non-interacting cavities are small. The terminal accelerating cavities 26 and 28 are made as one-half of an interior cavity 16, 18 and as a result the overall accelerator structure is symmetric relative to rf input coupler 15.

The spacing between accelerating cavities 16, 18 is about one-half of a free-space wavelength, so that electrons accelerated in one cavity 16 will arrive to the next accelerating cavity in right phase relative to the microwave field for additional acceleration. After being accelerated, beam 12 strikes an x-ray target 32. Alternatively, 32 may be a vacuum window of metal thin enough to transmit the electrons for particle irradiation of a subject.

If all the accelerating cavities 16, 18 and all the coupling cavities 20 are similar and mirror-image symmetrical about their center planes, the field in all accelerating cavities will be substantially the same.

To adjust the final output energy of beam 12, one of the coupling cavities, 34, is built so that it can be made asymmetrical by a mechanical adjustment. The geometrical asymmetry produces an asymmetry of the electromagnetic field distribution in the coupling cavity 34 so that the magnetic field component is greater at one iris 38 than at the other iris 40. The coupled magnetic field is thus greater in the preceding cavities 16 coupled thru iris 38 than in the following cavities 18 coupled thru iris 40. Since the cavities 16, 18 are identical, then the ratio of accelerating fields in the cavities 16 and 18 is directly proportional to the ratio of magnetic fields on irises 38 and 40. By varying the degree of magnetic asymmetry in the coupling cavity 34, the rf voltage in the accelerating field in the following chain 18 can be varied while leaving the accelerating field constant in the cavities 16 near the beam injection region. Thus, the energy of the output beam electrons can be selectively adjusted.

Since the formation of electron bunches from an initial continuous beam takes place in the first cavities 16 traversed, the bunching can be optimized there and not degraded by the varying accelerating field in the output cavities 18. The spread of energies in the output beam is thus made independent of the varying mean output electron energy.

The varying energy lost by the output cavities 18 to the beam will of course change the load impedance seen by the microwave source (not shown) producing small reflected microwave power from iris 15. This change is small and can easily be compensated either by variable impedance or by adjusting the microwave input power.

In operation, the maximum accelerating field is generally limited by high-vacuum arcing across a cavity. Thus, the field in output cavities 18 will generally be varied from a value equal to the field in input cavities 16 for maximum beam energy, down to a lower value for reduced beam energy.

In the accelerator of FIG. 1 the asymmetry in cavity 34 is produced by lengthening one of its center conductor posts 36 while shortening the other post 36. The resonant frequency of cavity 34 can be held constant by adjusting the gap between posts 36. The rf magnetic field will be higher on the side with the longer center post 36 and, hence, the coupling coefficient to the adjacent cavity will be greater on this side.

FIG. 2 shows cavity 34 in more detail. Center posts 36 are moved independently inside fixed collars 41. Contact for the circulating rf current is made by coil springs 42 as of tungsten wire. The movement is transmitted thru the vacuum wall of accelerator section 10 via metallic bellows 43. The post motion is individually programmed to keep the resonant frequency of the coupling cavity 34 constant.

It will be apparent to those skilled in the art that very many ways may be used to change a cavity and hence, its electromagnetic field, from symmetrical to an adjustable degree of asymmetry. The mechanisms of FIGS. 2, 3 and 4 are only selected examples.

In FIG. 3, the asymmetry is produced by capacitive loading of the coaxial cavity 34'. Two capacitive loading plates 46 are moved in push-pull coordination, one closer to a stationary center conductor 36' while the other is moved farther away from the other stationary center conductor 36'. The circulating cavity current and, hence, the rf magnetic field, is increased in the end of cavity 34' where the capacitive loading is increased, and vice versa. Loading plates 46 are mounted on push rods 48 which are moved in the vacuum via metallic bellows 50. A center-pivoted bar 52 ties together the push-pull motion.

FIG. 4 shows variable asymmetrical inductive loading. A pair of massive metallic rings 54 fill most of the cross section of coaxial cavity 34'' and are apertured to move along but not contact stationary center conductors 36''. As they are moved in the same direction, the inductance is decreased in the end of cavity 34'' toward which they move, and vice versa. The loading ring also tends to cover over the near iris 22'', further reducing the coupling to interaction cavity 16. Rings 54 are mounted together on one or more dielectric rods 56 and moved axially via a bellows vacuum seal 58. In a slightly different embodiment only a single ring 54 may be used, moving it from one end of coupling cavity 34''' to the other. Although the double and single rings 54 are preferably metallic, they may also be dielectric.

In the above-illustrated embodiments, the asymmetrically coupled cavity is a side cavity. This is believed to be the preferred embodiment.

If the accelerator is of the type not having side cavities, then asymmetry can be produced in a cavity which is traversed by the particle beam.

The above are only selected examples of the many different possible embodiments of the invention which might occur to those skilled in the art. Any way to produce adjustably asymmetric fields in any cavity in the chain will produce the desired effect. The true scope of the invention is to be limited only by the following claims and their legal equivalents.

We claim:

1. In an accelerator for accelerating a particle beam, a resonant chain of electromagnetic cavities coupled in series and resonant at approximately the same frequency, one of said cavities being coupled to each of two adjacent cavities, and adjustable means for changing the distribution of electromagnetic field within said one cavity such that the magnitude of the field coupling between said one cavity and a first of said adjacent cavities is substantially varied with respect to the magnitude of the field coupling between said one cavity and the second of said adjacent cavities, while maintaining substantially said approximately same frequency and without causing a change in the phase of the field in said one cavity.

2. An accelerator for accelerating a particle beam, said accelerator comprising a chain of electromagnetic cavities coupled in series, one of said cavities being coupled to each of two adjacent cavities, adjustable means for changing the distribution of the electromagnetic field within said one cavity such that the magnitude of the field coupling between said one cavity and a first of said adjacent cavities is substantially varied with respect to the magnitude of the field coupling between said one cavity and the second of said adjacent cavities, said adjustable means being adjustable in an amount sufficient to cause said respective variation of the magnitude of the field coupling to be great enough to cause substantial change in the output energy of said particle beam and without causing a shift in the phase of the field in said one cavity.

3. An accelerator as claimed in claim 2 wherein said adjustable means is also adjustable to cause the distribution of the electromagnetic field in said one cavity to be such that the magnitude of the field coupling between said one cavity and a first of said adjacent cavities is substantially equal to the magnitude of the field coupling between said one cavity and the second of said adjacent cavities.

4. The accelerator of claim 2 wherein said adjustable means comprises means for producing a variable degree of asymmetry in the configuration of said one cavity with respect to said adjacent cavities.

5. The accelerator of claim 2 wherein said coupling is through irises and said means for changing the distribution comprises means for changing the distribution of magnetic field of the cavity resonance with respect to said irises.

6. The accelerator of claim 2 wherein said one cavity is cylindrical, and said adjustable means for changing the electromagnetic field in said one cavity comprises a reentrant center conductor of adjustable length.

7. The accelerator of claim 6 wherein said one cavity has a pair of opposing reentrant center conductors each of adjustable length.

8. The accelerator of claim 7 wherein said adjustable means comprises means for increasing the length of one of said center conductors and means for decreasing the length of the other.

9. The accelerator of claim 2 wherein said chain comprises two sets of cavities, the cavities of a first of said sets alternating in the series chain with the cavities of the second of said sets, the cavities of said first set being of different configuration from the cavities of said second set.

10. The accelerator of claim 9 wherein the cavities of said first set are accelerating cavities having aligned apertures for passage of a linear beam of particles and the cavities of said second set are coupling cavities removed from said beam.

11. The accelerator of claim 9 wherein said chain is adapted to resonate with a phase shift of $\pi/2$ radians between adjacent cavities.

12. The accelerator of claim 10 wherein said one cavity is one of said coupling cavities.

13. The accelerator of claim 12 wherein said adjustable means comprises means for producing variable asymmetry in the configuration of said one coupling cavity with respect to the members of the adjacent pair of accelerating cavities.

14. The accelerator of claim 13 wherein said one coupling cavity is coaxial, having a reentrant center conductor of mechanically adjustable length.

15. The accelerator of claim 13 wherein said one coupling cavity is coaxial, having a pair of opposing reentrant center conductors each of mechanically adjustable length.

16. The accelerator of claim 15 further comprising means for simultaneously increasing the length of one of said center conductors while decreasing the length of the other.

17. A particle accelerator having a chain of electromagnetic cavities comprising at least two accelerating cavities, said accelerating cavities having holes through their walls for passage of a beam of charged particles and being coupled to said beam, said chain of cavities also having at least one coupling cavity which is substantially uncoupled from said beam and electromagnetically coupled to each of said two accelerating cavities, said coupling cavity having two reentrant conductor posts, adjustment means for changing the distribution of the electromagnetic field within said coupling cavity such that the magnitude of the field coupling between said coupling cavity and one of said accelerating cavities is greater than the field coupling between said coupling cavity and the other of said acceleration cavities, said adjustment means comprising at least one movable adjustment member in said coupling cavity and located externally of said conductor posts, and means for positioning said adjustment member asymmetrically with respect to said conductor posts.

18. The method of operating a particle accelerator having a chain of electromagnetic cavities coupled in series from an upstream inlet end for injection of a particle beam to a downstream end for exit of the accelerated beam, one of said cavities being coupled to each of two adjacent cavities, and adjustable means for changing the distribution of the electromagnetic field within said one cavity such that the magnitude of the field coupling between said one cavity and the adjacent upstream cavity may be varied with respect to the magnitude of the field coupling between said one cavity and the adjacent downstream cavity, said method comprising the steps of operating said adjustable means to one mode of adjustment such that the magnitude of the field coupling between said one cavity and said upstream cavity is substantially the same as it is between said one cavity and said downstream cavity to obtain high output energy of said particle beam, and operating said adjustable means to another mode of adjustment such that the magnitude of the field coupling between said one cavity and said upstream cavity is substantially different than the magnitude of the field coupling between said one cavity and said downstream cavity to obtain a lower output energy of said particle beam without causing a change in the phase of the field in said one cavity.

19. The method of operating a particle accelerator as claimed in claim 18 wherein the adjustment of said adjustable means in said other mode of adjustment is such that the magnitude of the field coupling between said one cavity and said upstream cavity is greater than the magnitude of the field coupling between said one cavity and said downstream cavity.

20. A particle accelerator having wall means forming a chain of electromagnetic cavities coupled in series, one of said cavities being an adjustment cavity coupled to each of two adjacent cavities, adjustment means for changing the distribution of the electromagnetic field within said adjustment cavity such that the magnitude of the field coupling between said adjustment cavity and one of its adjacent cavities is greater than the coupling between said adjustment cavity and the other of its adjacent cavities, said adjustment means comprising two movable adjustment members in said cavity, and means for moving said adjustment members to different positions with respect to the walls of said cavity.

21. A particle accelerator as claimed in claim 20 including means for moving said two adjustment members with respect to each other.

22. A particle accelerator having a chain of electromagnetic cavities comprising at least two accelerating cavities, said accelerating cavities having holes through their walls for passage of a beam of charged particles and being coupled to said beam, said chain of cavities having at least one coupling cavity which is substantially uncoupled from said beam and electromagnetically coupled to each of said two accelerating cavities, adjustment means for changing the distribution of the electromagnetic field within said coupling cavity such that the magnitude of the field coupling between said coupling cavity and one of said accelerating cavities is greater than the field coupling between said coupling cavity and the other of said accelerating cavities, said adjustment means comprising a movable adjustment member, and means for moving said adjustment member to more than one fixed position which causes said unequal field coupling between said coupling cavity and said accelerating cavities.

* * * * *